US005577386A

United States Patent [19]

Alary et al.

[11] Patent Number: 5,577,386

[45] Date of Patent: Nov. 26, 1996

[54] SYSTEM FOR COOLING A HIGH POWER FUEL INJECTOR OF A DUAL INJECTOR

[75] Inventors: Jean-Paul D. Alary, Saint Maur des Fosses; Guy D'Agostino, Vitry sur Seine; Henry R. Leclerc, Juvisy sur Orge; Denis Sandelis, Nangis; Pierre M. V. E. Schroer, Brunoy, all of France

[73] Assignee: Societe Nationale D'Etude et de Construction de Moteurs D'Aviation S.N.E.C.M.A., Paris Cedex, France

[21] Appl. No.: 493,206

[22] Filed: Jun. 20, 1995

[30] Foreign Application Priority Data

Jun. 20, 1994 [FR] France ..... 94 07624

[51] Int. Cl.[6] ..... B05B 15/00; F02C 3/14

[52] U.S. Cl. ..... 60/742; 60/747; 239/132.5

[58] Field of Search ..... 60/39.06, 740, 60/742, 746, 747; 239/132.5

[56] References Cited

U.S. PATENT DOCUMENTS 4,305,255 12/1981 Davies et al. .

5,269,468 12/1993 Adiutori ..... 60/740

5,528,896 6/1996 Alary et al. ..... 60/747

FOREIGN PATENT DOCUMENTS 2441725 11/1979 France .

819042 8/1959 United Kingdom ..... 239/132.5

WO94/08179 4/1994 WIPO .

*Primary Examiner*—Charles G. Freay

*Attorney, Agent, or Firm*—Bacon & Thomas

[57] ABSTRACT

The present invention relates to a system for cooling a high power fuel injector of a dual fuel injector wherein the system comprises a first fuel supply circuit having a first conduit connecting a fuel feed supply and the high power fuel injector, the first conduit having a terminal end adjacent to a distal end of the high power fuel injector, and a second conduit connecting the terminal end of the first conduit to the low power fuel injector such that all of the fuel supplied to the low power injector first passes through the high power fuel injector. The system also has a second fuel supply circuit, separate from the first fuel supply circuit, which comprises a third conduit connecting the fuel feed supply and the fuel injection orifices of the high power fuel injector so as to supply fuel to the fuel injection orifices.

6 Claims, 3 Drawing Sheets

SYSTEM FOR COOLING A HIGH POWER FUEL INJECTOR OF A DUAL INJECTOR

BACKGROUND OF THE INVENTION

The present invention relates to a system for cooling a high power or takeoff fuel injector portion of a dual fuel injector used in a dual head combustion chamber of a gas turbine engine.

In modern jet powered aircraft, a dual head combustion chamber is used in the turbojet engine to achieve the required pollution control levels, while at the same time obtaining optimal performance of the engine. The dual head combustion chambers are fed with fuel by way of a dual injector comprising a first or low power fuel injector for injecting fuel into the low power portion of the dual head combustion chamber and a second, high power, or takeoff, fuel injector for injecting fuel into the enhanced performance portion of the dual head and combustion chamber.

In such dual head combustion chambers, the low power fuel injector is permanently supplied with fuel regardless of the operating mode of the gas turbine engine. However, the high power or takeoff fuel injector is supplied with fuel only when the engine is operated beyond a specific minimum operating mode, generally corresponding to approximately 20% of the nominal operating mode. Accordingly, during operation in the low power mode, the high power fuel injector must be suitably cooled, particularly in the nozzle portion containing the fuel injector orifices in order to avoid encoking of the fuel and to preclude fuel vapor locks.

It is known to provide a cooling system for the high power fuel injector by circulating fuel feeding the low power injector inside the high power fuel injector, thereby cooling the high power injector. However, in the known applications, it is only the fuel in the primary circuit of the low power fuel injector which circulates through the high power fuel injector. The known fuel injectors are double flow for each module aeromechanical injectors. The fuel supply circuit in the low power fuel injectors comprises two coaxial tubes and the high power injector is supplied by a third tube at the center of the first two coaxial tubes and which communicates with the combustion chamber through fuel injection orifices in the nozzle terminal. The location of these orifices is far from the passage between the ends of the first two tubes and the cooling of this area is not entirely satisfactory.

SUMMARY OF THE INVENTION

The present invention relates to a system for cooling a high power fuel injector of a dual fuel injector wherein the system comprises a first fuel supply circuit having a first conduit connecting a fuel feed supply and the high power fuel injector, the first conduit having a terminal end adjacent to a distal end of the high power fuel injector, and a second conduit connecting the terminal end of the first conduit to the low power fuel injector such that all of the fuel supplied to the low power injector first passes through the high power fuel injector. The system also has a second fuel supply circuit, separate from the first fuel supply circuit, which comprises a third conduit connecting the fuel feed supply and the fuel injection orifices of the high power fuel injector so as to supply fuel to the fuel injection orifices.

An object of the present invention is to improve the cooling of the high power fuel injector, in particular, the cooling of the nozzle portion adjacent to a distal end.

Communication between the terminal end of the first conduit and the second conduit may be achieved by a plurality of channels extending around a central axis of the nozzle portion. The plurality of channels may alternate with the plurality of fuel injection orifices in a circumferential direction about the central axis.

The present design increases the cooling of the distal end of the high power fuel injector adjacent to the fuel injection orifices by increasing the flow of cooling fuel and optimizing the heat exchange surfaces in this area of the high power fuel injector.

DETAILED DESCRIPTION OF THE PREFERRED EMBODIMENT

Figure 1:
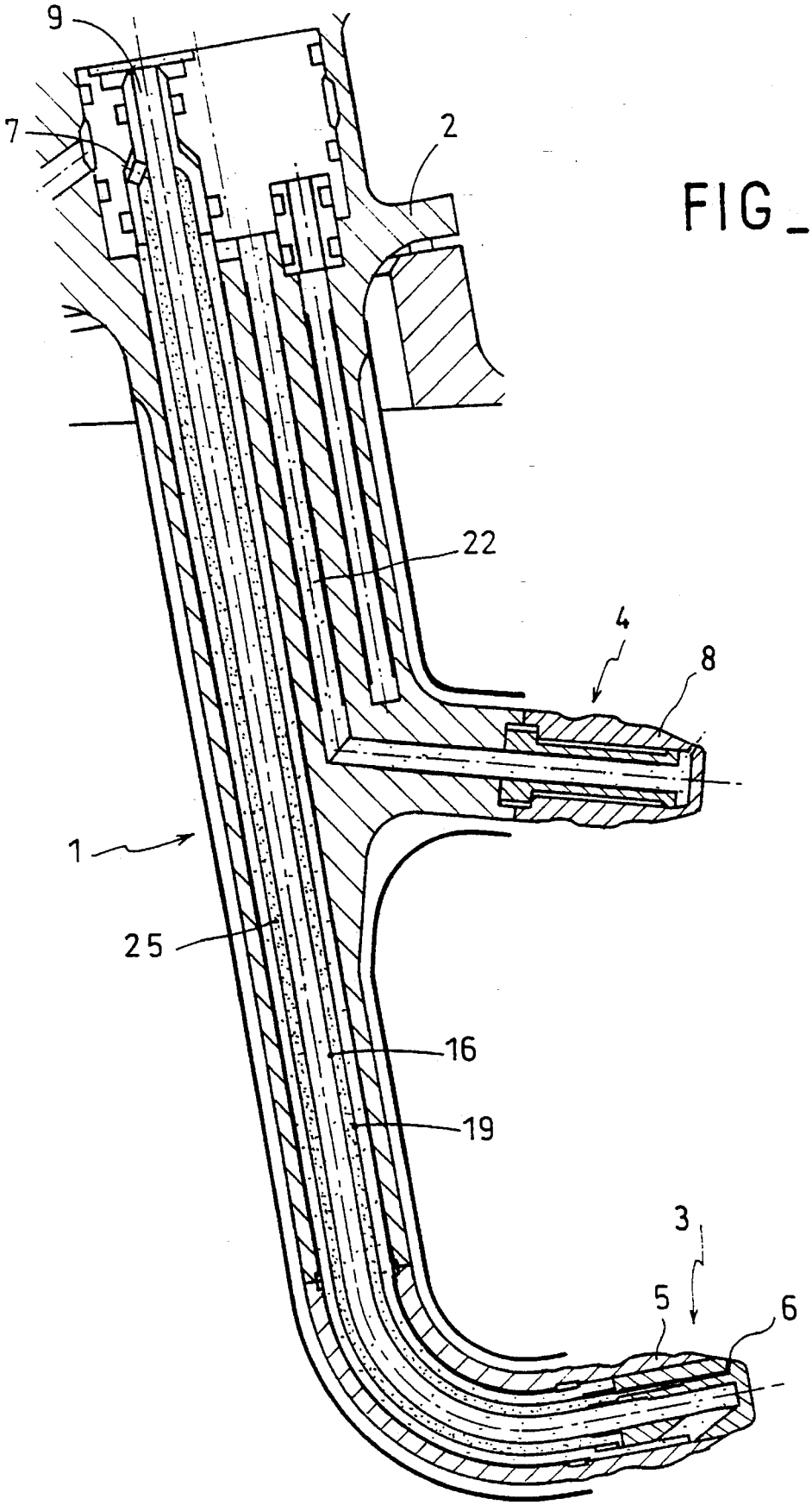
FIG. 1 is a cross-sectional view of a dual head fuel injector having a cooling system according to the present invention.

As illustrated in FIG. 1, a dual injector 1, in known fashion, feeds fuel to an annular, dual head gas turbine engine combustion chamber and includes a head portion 2 for mounting the fuel injector to the outer case of the gas turbine engine (not shown). The dual injector comprises a high power, or takeoff, fuel injector 3 displaced away from the head portion 2 and a low power fuel injector 4 located approximately halfway between the head portion 2 and the high power fuel injector 3. The high power injector 3 comprises a high power nozzle 5 with fuel injection orifices 6 in order to inject a fuel flow introduced through the head portion 2 and orifice 7 into the combustion chamber. The low power injector 4 also comprises a low power nozzle 8 supplied with fuel introduced into the head portion 2 through a supply orifice 9.

The high power nozzle 5 comprises a distal or terminal end portion 10 mounted in a bore hole 11 of member 12 which is, in turn, mounted on the end of a hollow body 13 forming the outer wall of the dual injector 1.

The nozzle terminal or distal end 10 has a central axis 14 and an axially extending, blind bore hole 15, which communicates with the fuel supply orifice 9 through a first tube or conduit 16. The terminal or distal end portion 10 also comprises an annular cavity 17 coaxially in communication with a plurality of fuel injection orifices 6. The annular cavity 17 encloses the blind bore hole 15 and is separated therefrom by a generally cylindrical sleeve 18, an upstream end of which is affixed to the end of first tube or conduit 16. A second tube or conduit 19 is affixed to an upstream end of the annular wall separating the annular cavity 17 from the member 12 to establish communication between the annular cavity 17 and the orifice 7 located in the head portion 2. Second tube 19 also encloses the first tube or conduit 16 and is generally coaxial therewith. Annular space 20 is bounded by the second tube 19 on one side and by the hollow body 13 on the other. A plurality of channels 21 are located in the nozzle end portion 10 in order to establish communication between the terminal end of the blind bore hole 15 and the annular space 20.

Annular space 20 extends from the distal end of the high power injector 3 to the head portion 2 where it communicates permanently with the feed channel 22 of the low power fuel injector 4. The annular space 20 is externally bounded by a third tube 23 of which of the downstream end 24 is affixed in a sealing manner to the member 12.

The fuel supply circuit for the low power fuel injector 4 comprises intake orifice 9, the internal passage of first tube or conduit 16, the blind bore hole 15, the plurality of channels 21, the annular space or conduit 20 and the feed passage 22. Accordingly, all of the fuel flow $Q_1$ that is supplied to the low power fuel injector 4 must pass through the channels 21 located in the terminal end portion 10 of the nozzle 5.

The fuel supply circuit for the high power injector 3 comprises the intake orifice 7, the annular space 25 bounded by the first tube 16 and the second tube 19, the annular cavity 17 and the fuel injection orifices 6.

Figure 3:
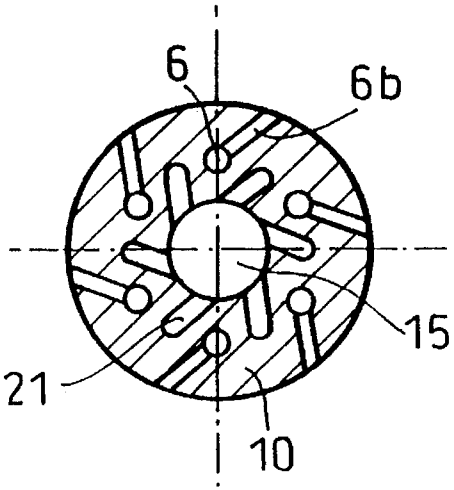
FIG. 3 is a cross-sectional view taken along line III—III in FIG. 2.
Figure 2:
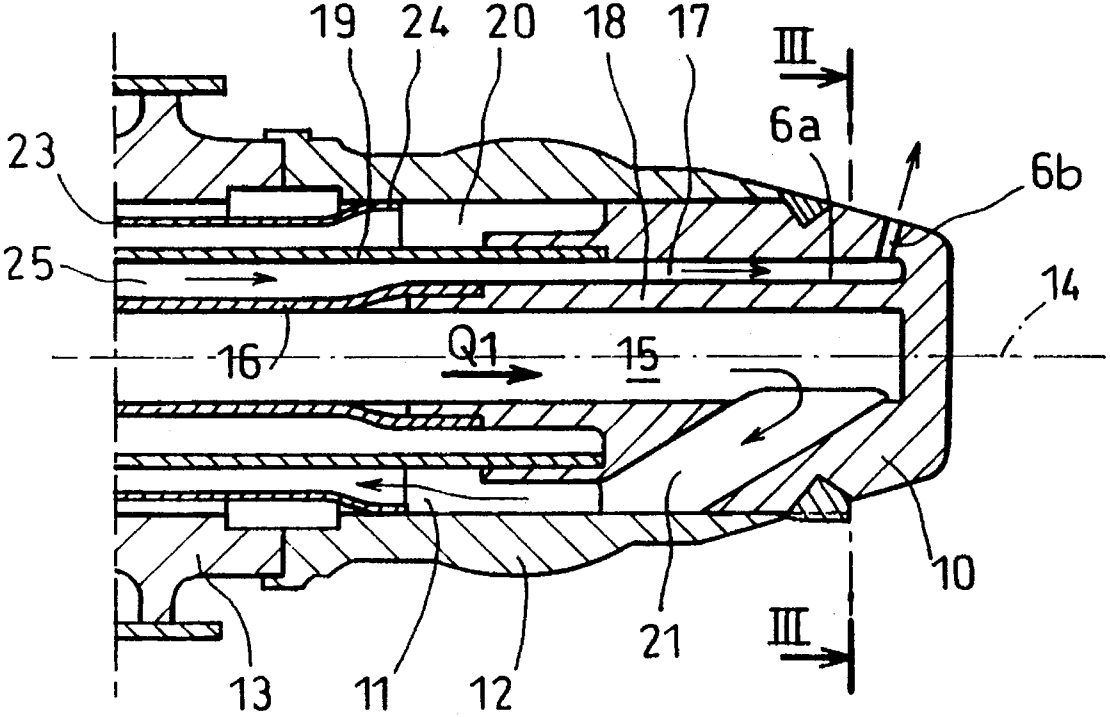
FIG. 2 is an enlarged, cross-sectional view of the distal end of the high power fuel injector illustrated in FIG. 1.
Figure 4:
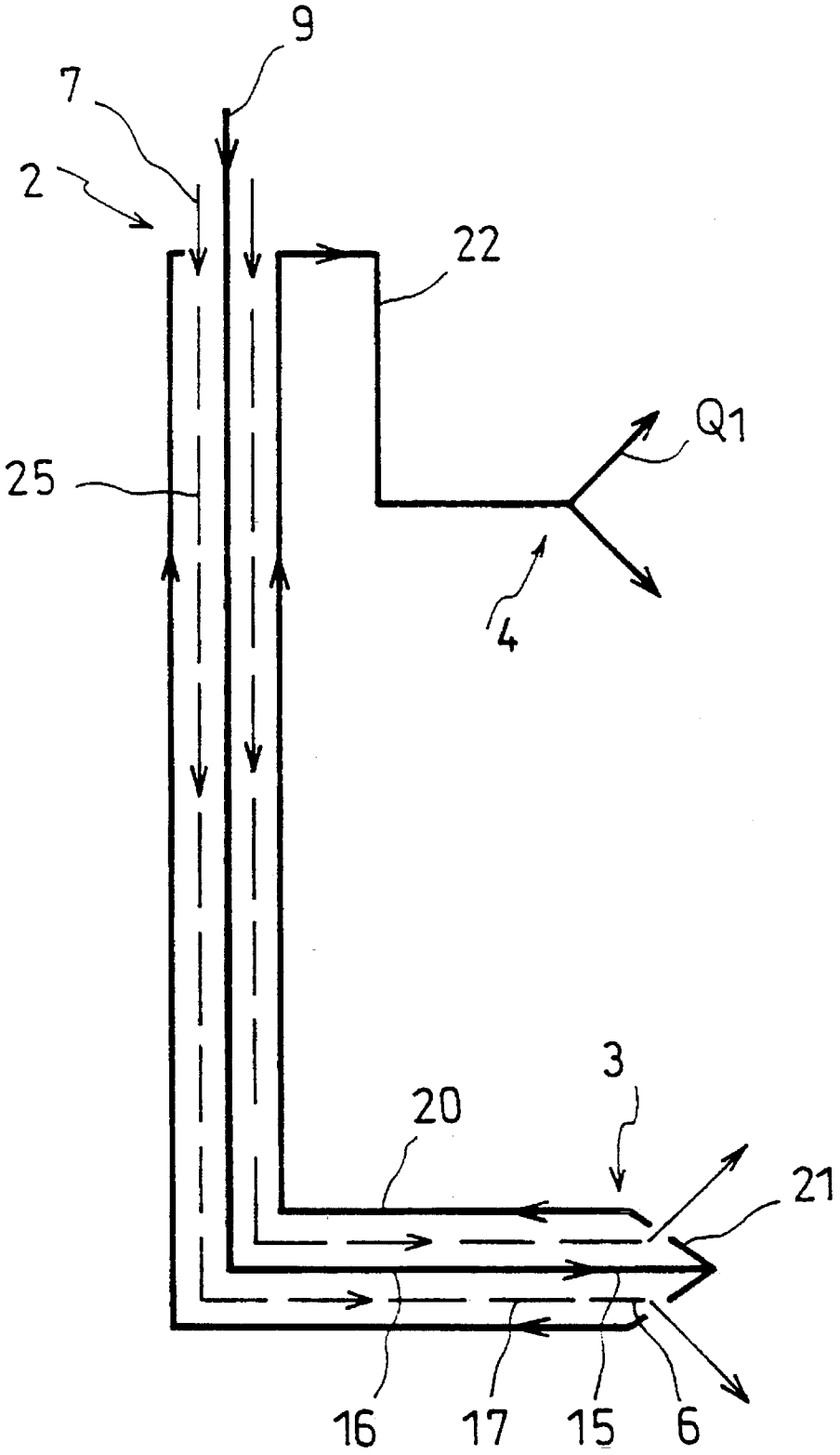
FIG. 4 is a schematic diagram illustrating the fuel circulation flow in the nozzle having a cooling system according to the present invention.

As best shown in FIGS. 2 and 3, each of the fuel injection orifices 6 comprise, starting adjacent to the annular cavity 17, a first, axial portion 6*a* and a second, radially and tangentially extending portion 6*b*, which communicates with the combustion chamber of the engine. In the embodiment shown, there are six injection orifices, although it is to be understood that various numbers may be utilized depending upon the requirements of each specific application.

There are also six channels 21 which alternate circumferentially with the fuel injection orifices 6. As a result, the distal end portion 10 of the fuel injection nozzle 5, being the hottest area of the fuel injector 1 and, consequently, the portion of the injector that is most sensitive to coking, has a large heat exchange surface interacting with the fuel flow $Q_1$ for the low power injector 4. Therefore, the danger of coking of the residual fuel in the high power fuel circuit due to the temperature drop of the high power fuel circuit walls is substantially decreased. Heat calculations show that a substantial gain of 68% at the surface of the walls at risk, regarding coking, that is at a temperature in excess of 200° C.

The foregoing description is provided for illustrative purposes only and should not be construed as in any way limiting this invention, the scope of which is defined solely by the appended claims.

We claim:

1. A system for cooling a high power fuel injector of a dual fuel injector also having a low power fuel injector, the dual fuel injector being connected to a fuel feed supply and the high power fuel injector having a plurality of fuel injection orifices, the system comprising:

a) a first fuel supply circuit comprising: a first conduit connecting the fuel feed supply and the high power fuel injector, the first conduit having a terminal end adjacent to a distal end of the high power fuel injector; and a second conduit connecting the terminal end of the first conduit to the low power fuel injector such that all fuel supplied to the low power injector must pass through the first and second conduits; and b) a second fuel supply circuit separate from the first fuel supply circuit comprising a third conduit connecting the fuel feed supply and the fuel injection orifices so as to supply fuel to the fuel injection orifices.

2. The system of claim 1 wherein at least portions of the first and second conduits are coaxial.

3. The system of claim 2 wherein the third conduit is coaxial with the first and second conduits.

4. The system of claim 3 wherein the third conduit is located between the first and second conduits.

5. The system of claim 1 further comprising a plurality of channels connecting the terminal end of the first conduit to the second conduit.

6. The system of claim 1 wherein the terminal end of the high power fuel injector has an axis and wherein the plurality of channels and the fuel injection orifices alternate in a circumferential direction around the axis.

* * * * *